US012514375B2

(12) United States Patent
Chen

(10) Patent No.: US 12,514,375 B2
(45) Date of Patent: Jan. 6, 2026

(54) MATTRESS

(71) Applicant: JingWeiLianHe (Hong Kong) Technology Co., Limited, Hong Kong (HK)

(72) Inventor: Xin Chen, Hong Kong (HK)

(73) Assignee: JingWeiLianHe (Hong Kong) Technology Co., Limited, Hong Kong (HK)

( * ) Notice: Subject to any disclaimer, the term of this patent is extended or adjusted under 35 U.S.C. 154(b) by 0 days.

(21) Appl. No.: 18/398,640

(22) Filed: Dec. 28, 2023

(65) Prior Publication Data

US 2025/0194813 A1 Jun. 19, 2025

(30) Foreign Application Priority Data

Dec. 18, 2023 (CN) ..... 202323453884.X

(51) Int. Cl.
*A47C 27/00* (2006.01)
*A47C 27/22* (2006.01)

(52) U.S. Cl.
CPC ..... *A47C 27/002* (2013.01); *A47C 27/22* (2013.01)

(58) Field of Classification Search
CPC ..... A47C 27/002; A47C 27/22; A47C 27/15
USPC ..... 5/724
See application file for complete search history.

(56) References Cited

U.S. PATENT DOCUMENTS 82,975 A * 10/1868 Morey ..... A47C 27/15 5/951
3,090,972 A * 5/1963 Pelletier ..... A47C 27/001 5/724
3,737,929 A * 6/1973 Golembeck ..... A47C 31/02 5/737
4,651,370 A * 3/1987 Vitale ..... A47G 9/0246 5/500
4,665,575 A * 5/1987 Raught ..... A47C 21/046 5/724
5,046,207 A * 9/1991 Chamberlain ..... A47G 9/0246 5/497
5,325,555 A * 7/1994 Whitley ..... A47C 31/105 5/500
6,088,858 A * 7/2000 Juster ..... A47C 31/105 5/691
12,279,699 B2 * 4/2025 Alletto, Jr. ..... A47C 27/003
2004/0128764 A1 * 7/2004 McGrath ..... A47C 27/005 5/498

(Continued)

*Primary Examiner* — Myles A Throop

(57) ABSTRACT

A mattress includes a wrapping body provided with a plurality of cavities independently set with each other. A first filling material arranged in each cavity. A second filling material arranged in each cavity. The first filling material and the second filling material are different materials. Through the above structure, the mattress of present disclosure is filled with at least two different types of filling materials, as compared to the mattresses on the market filled with a single type of material, which two different materials of present disclosure would provide both fully usability of the individual characteristics of each material and combining advantages brought by different materials. For example, combining materials with flexibility and elasticity properties for the filling can provide both a soft feel and a sufficient elastic support. A mattress filled with a combination of two types of materials can improve the user's sleep experience.

13 Claims, 4 Drawing Sheets

(56) References Cited

U.S. PATENT DOCUMENTS

| | | | | |
|---|---|---|---|---|
| 2007/0067916 | A1* | 3/2007 | Poston | A47C 31/105 5/691 |
| 2012/0324646 | A1* | 12/2012 | Briganti | A47G 9/0246 5/496 |
| 2013/0263377 | A1* | 10/2013 | Wootten, Jr. | A47C 27/15 5/640 |
| 2014/0304921 | A1* | 10/2014 | Collins | A47C 27/148 5/690 |
| 2017/0251825 | A1* | 9/2017 | Pearce | A47C 27/14 |
| 2018/0344049 | A1* | 12/2018 | Szpyt | D04B 1/22 |
| 2022/0192145 | A1* | 6/2022 | Lopez | A01K 1/0353 |
| 2024/0008662 | A1* | 1/2024 | Goenka | A47G 9/02 |
| 2024/0090687 | A1* | 3/2024 | Micklos | A47G 9/0253 |

* cited by examiner

MATTRESS

CROSS-REFERENCE TO RELATED APPLICATIONS

The application claims priority of Chinese patent application CN202323453884X, filed on Dec. 18, 2023, which is incorporated herein by reference in its entireties.

TECHNICAL FIELD

The present disclosure relates to the technical field of mattress, and in particular, to a mattress.

BACKGROUND

In modern life, a demand for sleep quality is increasingly high. Traditional mattresses often use springs or conventional sponge filling, which are limited in terms of softness, elasticity, and personalized adaptability. Many users complain about the insufficient softness or elasticity of the mattresses available on the market, leading to poor sleep quality.

Therefore, there is an urgent need in the market for a mattress that overcomes the shortcomings in softness and adaptability of traditional mattresses. By combining different filling materials and structural designs, this mattress would provide a combination of softness, elasticity, and personalized support. Such a mattress would not only improve the user's sleep experience but also help to reduce bodily fatigue and promote spinal health.

SUMMARY

According to the prior art, the present disclosure provides a mattress that provides both a sensation of softness and elastic support.

The technical solution adopted by the present disclosure to solve the technical problem is as follows:

A mattress, including:

a wrapping body, wherein the wrapping body includes a cavity;

at least one first filling material, wherein the first filling material is arranged in the cavity;

at least one second filling material, wherein the second filling material is arranged in the cavity, wherein the first filling material and the second filling material are different materials.

As the improvement of the present disclosure, the first filling material is a flexible material filler, and the flexibility of the first filling material is greater than the second filling material.

As the improvement of the present disclosure, the second filling material is an elastic material filler, and the elasticity of the second filling material is greater than the first filling material.

As the improvement of the present disclosure, the first filling material includes a number of chemical fibers.

As the improvement of the present disclosure, the second filling material includes a number of memory foam or a number of sponge.

As the improvement of the present disclosure, three layers of filling materials are arranged in the cavity, and the three layers are successively filled with the first filling material, the second filling material, and the first filling material from top to bottom.

As the improvement of the present disclosure, two layers of filling materials are arranged in the cavity, and the two layers are successively filled with the first filling material and the second filling material from top to bottom.

As the improvement of the present disclosure, two layers of filling materials are arranged in the cavity, and the two layers are successively filled with the second filling material and the first filling material from top to bottom.

As the improvement of the present disclosure, one layer of filling material are arranged in the cavity, which is a mixture of the first filling material and the second filling material.

As the improvement of the present disclosure, the second filling material further includes gel particles.

As the improvement of the present disclosure, the mattress includes a bed surround, the bed surround is fixedly connected to a lower surface around the wrapping body, and a bottom of the bed surround is arranged with a tightening edge.

As the improvement of the present disclosure, the bed surround is an elastic bed surround, and the tightening edge is an elastic drawstring.

As the improvement of the present disclosure, the mattress further includes tightening straps, and the tightening straps are arranged at the corners of the wrapping body.

As the improvement of the present disclosure, a number of the tightening straps are four, and the tightening straps are elastic tightening straps.

As the improvement of the present disclosure, the mattress further includes a number of quilting lines, and a number of the quilting lines divide the mattress into a number of mattress units.

As the improvement of the present disclosure, the wrapping body includes an upper layer, a side edge, and a lower layer, an upper edge of the side edge is fixedly connected to a border of the upper layer, and a lower edge of the sides is fixedly connected to a border of the lower layer, and the upper layer, the sides, and the lower layer together form the wrapping body.

As the improvement of the present disclosure, the upper layer and the lower layer are made of fabric, and the sides is arranged with a number of ventilation holes.

As the improvement of the present disclosure, a first support bar is arranged at the connection between the sides and the upper layer, and a second support bar is arranged at the connection between the sides and the lower layer.

Beneficial effects of the present disclosure are as follows: The present disclosure provides a mattress, the mattress includes a wrapping body provided with a cavity; at least one first filling material arranged in the cavity; and at least one second filling material arranged in the cavity. The first filling material and the second filling material are different materials. Through the above structure, the mattress of present disclosure is filled with at least two different types of filling materials, as compared to the mattresses on the market filled with a single type of material, which two different materials of present disclosure would provide both fully usability of the individual characteristics of each material and combining advantages brought by different materials. For example, combining materials with flexibility and elasticity properties for the filling can provide both a soft feel and a sufficient elastic support. A mattress filled with a combination of two types of materials can improve the user's sleep experience and contribute to reducing bodily fatigue and promoting spinal health.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
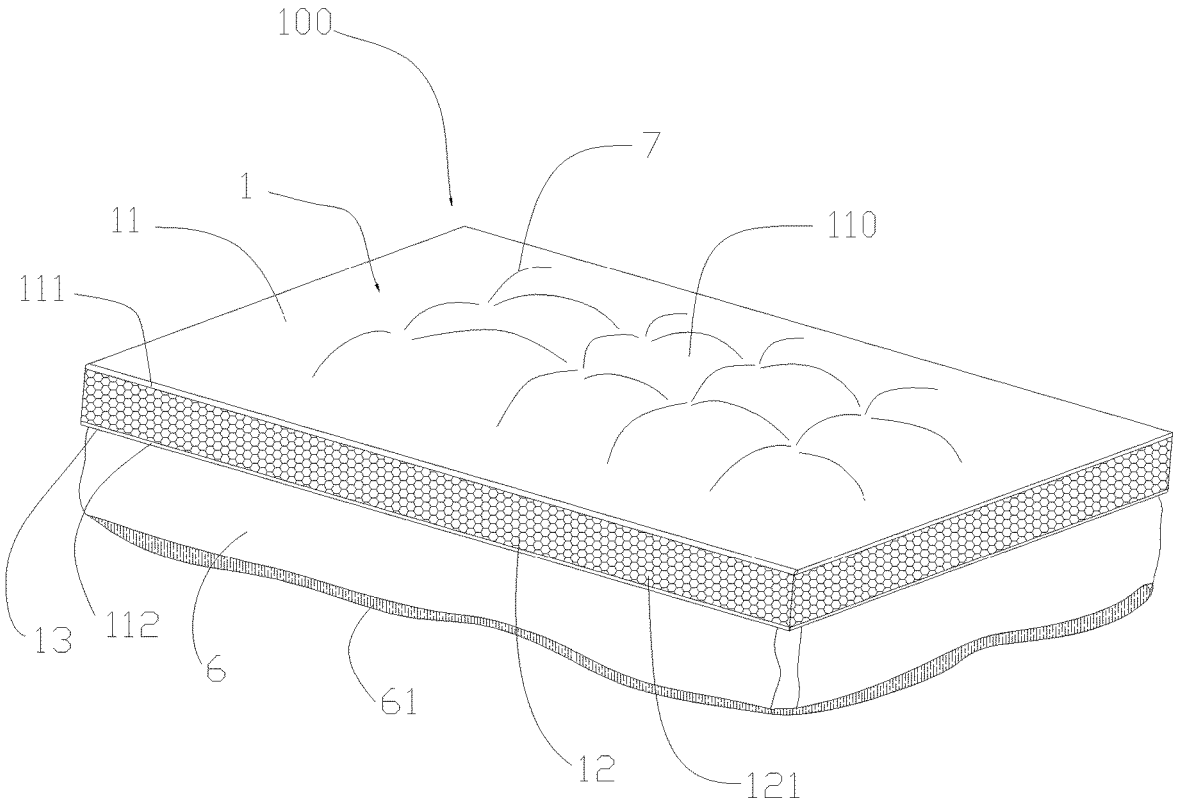
FIG. 1 shows a schematic diagram of an overall structure of the present disclosure.

Referring to FIG. 1 to FIG. 6, a mattress 100 includes a wrapping body 1 provided with a cavity 2; at least one first filling material 3 arranged in the cavity 2; and at least one second filling material 4 arranged in the cavity 2. The first filling material 3 and the second filling material 4 are different materials. Through the above structure, the mattress 100 of present disclosure is filled with at least two different types of filling materials, as compared to the mattresses on the market filled with a single type of material, which two different materials of present disclosure would provide both fully usability of the individual characteristics of each material and combining advantages brought by different materials. For example, combining materials with flexibility and elasticity properties for the filling can provide both a soft feel and a sufficient elastic support. A mattress filled with a combination of two types of materials can n improve the user's sleep experience and contribute to reducing bodily fatigue and promoting spinal health.

For an embodiment, the first filling material 3 is a flexible filling material, and a flexibility of first filling material 3 is greater than the second filling material 4. The second filling material 4 is an elastic filling material, and an elasticity of the second filling material 4 is greater than the first filling material 3. Through the above structure, since the first filling material 3 has soft feature, it can provide a soft and comfortable experience, reducing the burden on body pressure points and increasing the mattress's comfort. As the second filling material 4 has elastic properties, it adds a certain degree of resilience and support to the mattress, preventing it from easily collapsing. When both the first filling material 3 and the second filling material 4 jointly constitute the mattress's filling layer, they enable the mattress to provide a soft and comfortable experience combining materials with enhanced elasticity and support.

Preferably, the first filling material 3 includes a number of chemical fiber clusters 31. Through the above structure, the chemical fibers, being soft in texture, provide a soft feel to the mattress surface, thereby increasing overall comfort. Additionally, the chemical fibers possess good breathability, which aids in air circulation, and contribute to a more comfortable sleeping environment.

Preferably, the second filling material 4 includes a number of memory foam clusters 41 or sponge clusters 42. Through the above structure, memory foam exhibits excellent elasticity, which provide a support based on a shape and weight distribution of a body, so that alleviate a joint pressure, adapte to the body's contours better, provide a more tailored support and improve a sleep quality. Moreover, the memory foam clusters 41 provide a good durability, which can maintain their original shape and performance for an extended period, so that ensures retain a support and comfort of the mattress over time, and prolong a lifespan of the mattress.

Figure 2:
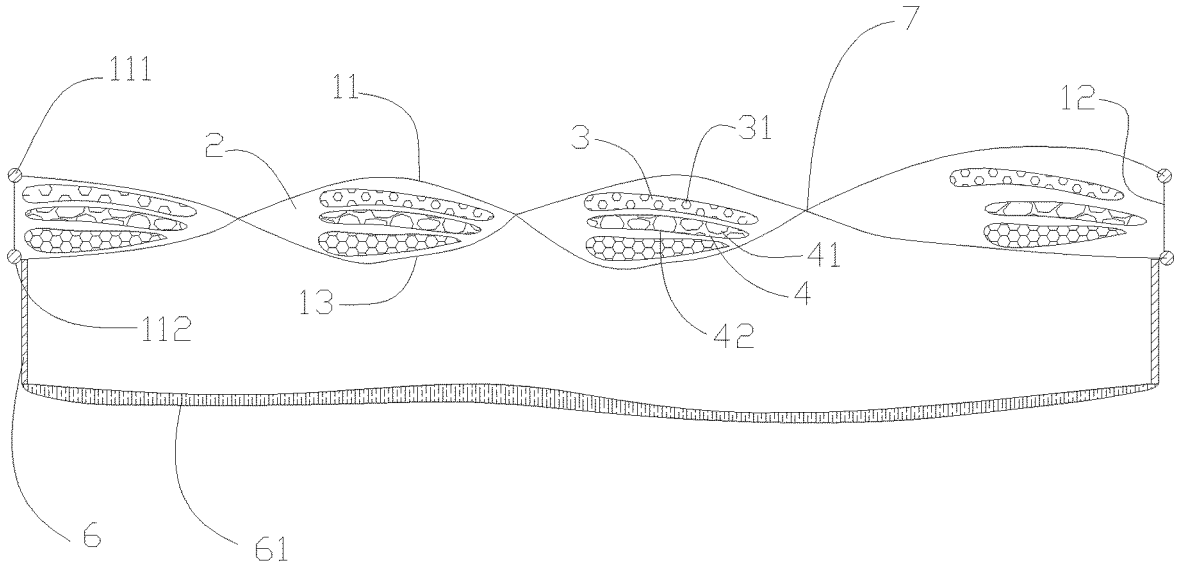
FIG. 2 shows a cross-sectional view of the present disclosure.
Figure 3:
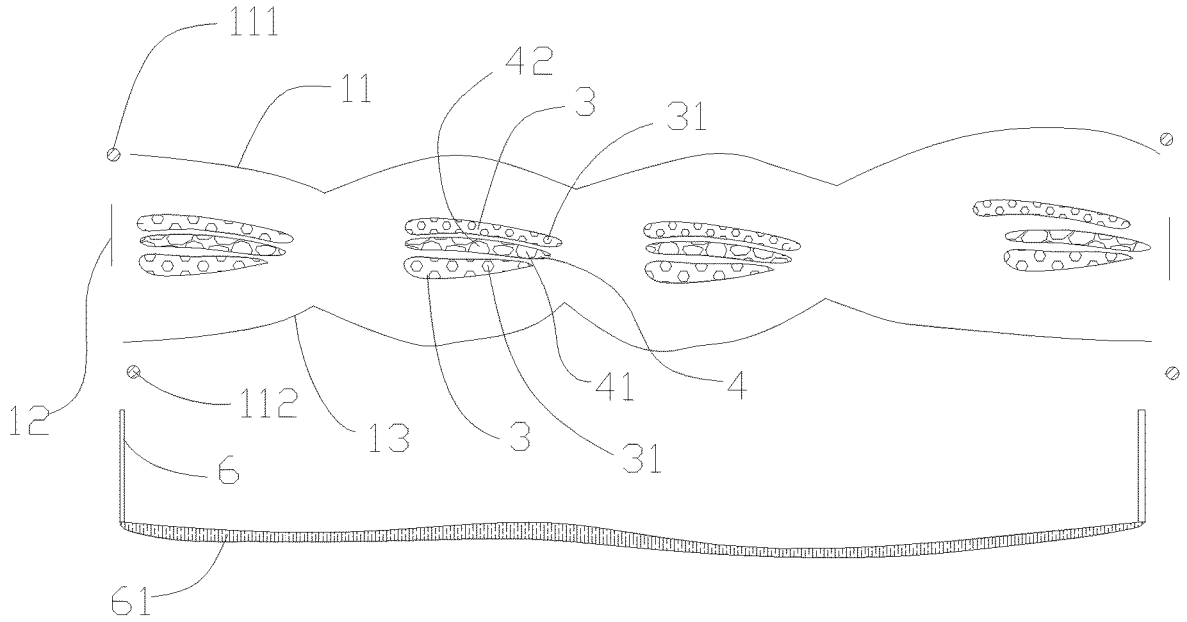
FIG. 3 shows an exploded view of the present disclosure.

For an embodiment, referring to FIG. 2, three layers of filling material are arranged in the cavity 2, which are successively filled from top to bottom with the first filling material 3, the second filling material 4, and again the first filling material 3. Specifically, the first filling material 3 includes a number of chemical fiber clusters 31, and the second filling material 4 includes either a number of memory foam clusters 41 or several sponge clusters 42. Through the above structure, three layers of filling materials are arranged in the cavity 2, wherein the middle layer of memory foam clusters 41 or sponge clusters 42 are sandwiched between a upper layer and a lower layer of chemical fiber clusters 31. This arrangement ensures that the mattress provide softness with elastic support. When a user lies on mattress 100, they immediately experience the softness provided by the chemical fiber clusters 31, while the memory foam clusters 41 or sponge clusters 42 provide elastic support, thereby enhancing the user's experience.

Figure 4:
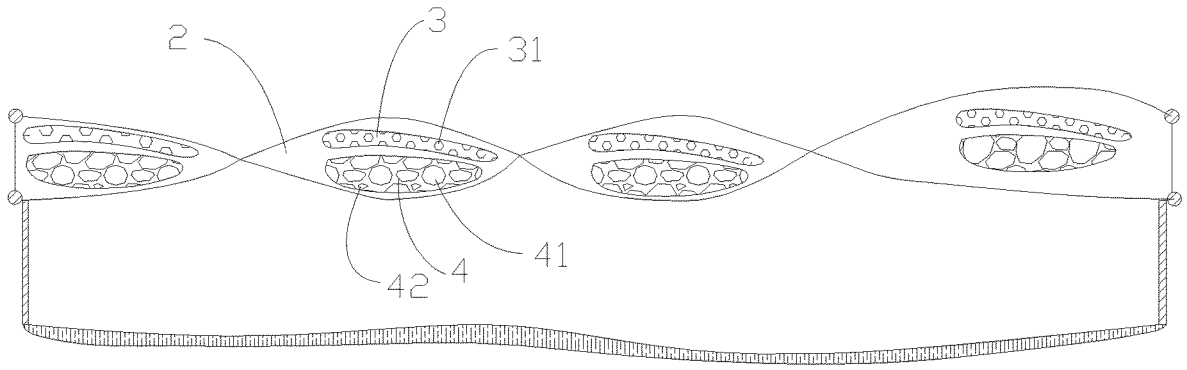
FIG. 4 shows a cross-sectional view of one embodiment of the present disclosure.

For another embodiment, referring to FIG. 4, two layers of filling material are arranged in the cavity 2, which are successively filled from top to bottom with the first filling material 3 and the second filling material 4. Specifically, the first filling material 3 includes a number of chemical fiber clusters 31, and the second filling material 4 includes either a number of memory foam clusters 41 or several sponge clusters 42. Through the above structure, two layers of filling materials are arranged in the cavity 2, the upper layer of chemical fiber clusters 31 and the lower layers of memory foam clusters 41 or sponge clusters 42. This arrangement ensures that the mattress provide softness with elastic support. When a user lies on mattress 100, they immediately experience the softness provided by the chemical fiber clusters 31, while the memory foam clusters 41 or sponge clusters 42 provide elastic support, thereby enhancing the user's experience.

Figure 5:
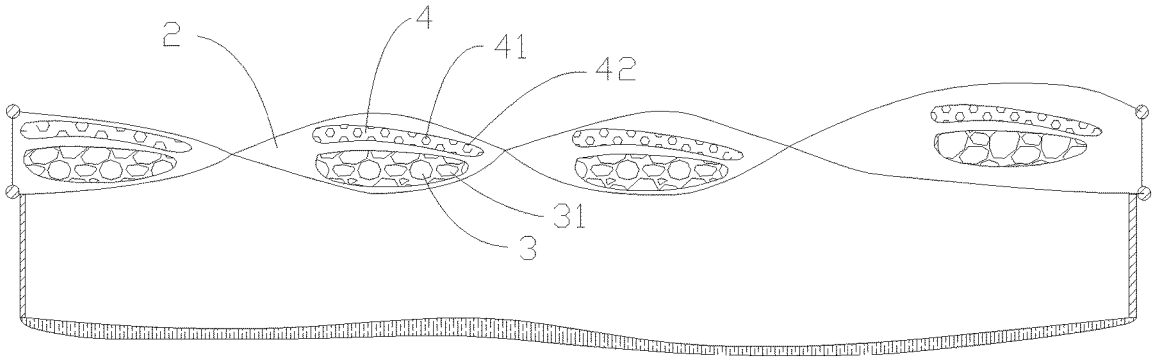
FIG. 5 shows a cross-sectional view of another embodiment of the present disclosure.

For one embodiment, referring to FIG. 5, two layers of filling material are arranged in the cavity 2, which are successively filled from top to bottom with the second filling material 4 and the first filling material 3. Specifically, the first filling material 3 includes a number of chemical fiber clusters 31, and the second filling material 4 includes either a number of memory foam clusters 41 or several sponge clusters 42. Through the above structure, the cavity 2 has two layers of filling materials, the upper layer of memory foam clusters 41 or sponge clusters 42, and the lower layer of chemical fiber clusters 31. This ensures that the mattress provides both softness and elasticity. Since the upper layer has memory foam clusters 41 or sponge clusters 42, this design meets the needs of users who prefer a more elastic mattress, achieving a balance between elastic support and comfort, and providing a comprehensive sleep experience.

Figure 6:
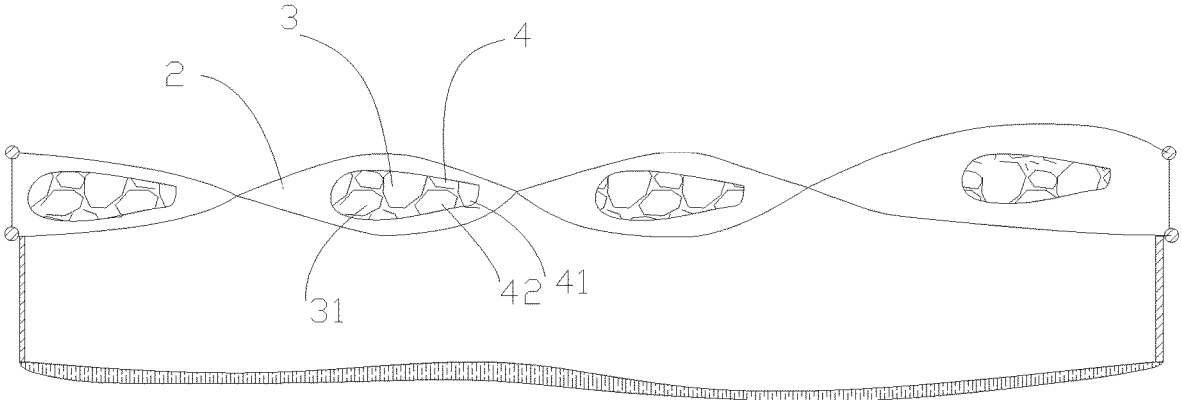
FIG. 6 shows a cross-sectional view of another embodiment of the present disclosure.

For another embodiment, referring to FIG. 6, the cavity 2 has a single layer of filling material, which is a mixture of the first filling material 3 and the second filling material 4. Specifically, the first filling material 3 includes a number of chemical fiber clusters 31, and the second filling material 4 includes either a number of memory foam clusters 41 or several sponge clusters 42. Through the above structure, mixing memory foam clusters 41 or sponge clusters 42 with chemical fiber clusters 31 perfectly combines the features of both types of filling materials, achieving a balance between elastic support and comfort, and providing a comprehensive sleep experience.

For this embodiment, the second filling material 4 further includes gel particles. Through the above structure, the gel particles provide improved ventilation and heat dissipation for mattress 100, contributing to maintaining a cool sensation on the surface of the mattress. Additionally, the gel material provides a degree of support, helping to alleviate bodily fatigue and promote spinal health.

For this embodiment, a bed surround 6 is also included, which is fixedly connected to the lower surface around the wrapping body 1, and the bottom of the bed surround 6 is arranged with a tightening edge 61. Specifically, the bed surround 6 is an elastic bed surround, with the tightening edge 61 being an elastic band. Through the above structure, the mattress 100 is used as a mattress cover. The elastic bed surround 6 effectively wrap around the mattress, maintaining a tight fit and reducing the likelihood of shifting, making the entire bed appear more tidy. Moreover, it helps prevent the mattress from sliding or falling off during use, maintaining the neatness and stability of the bedding.

Figure 7:
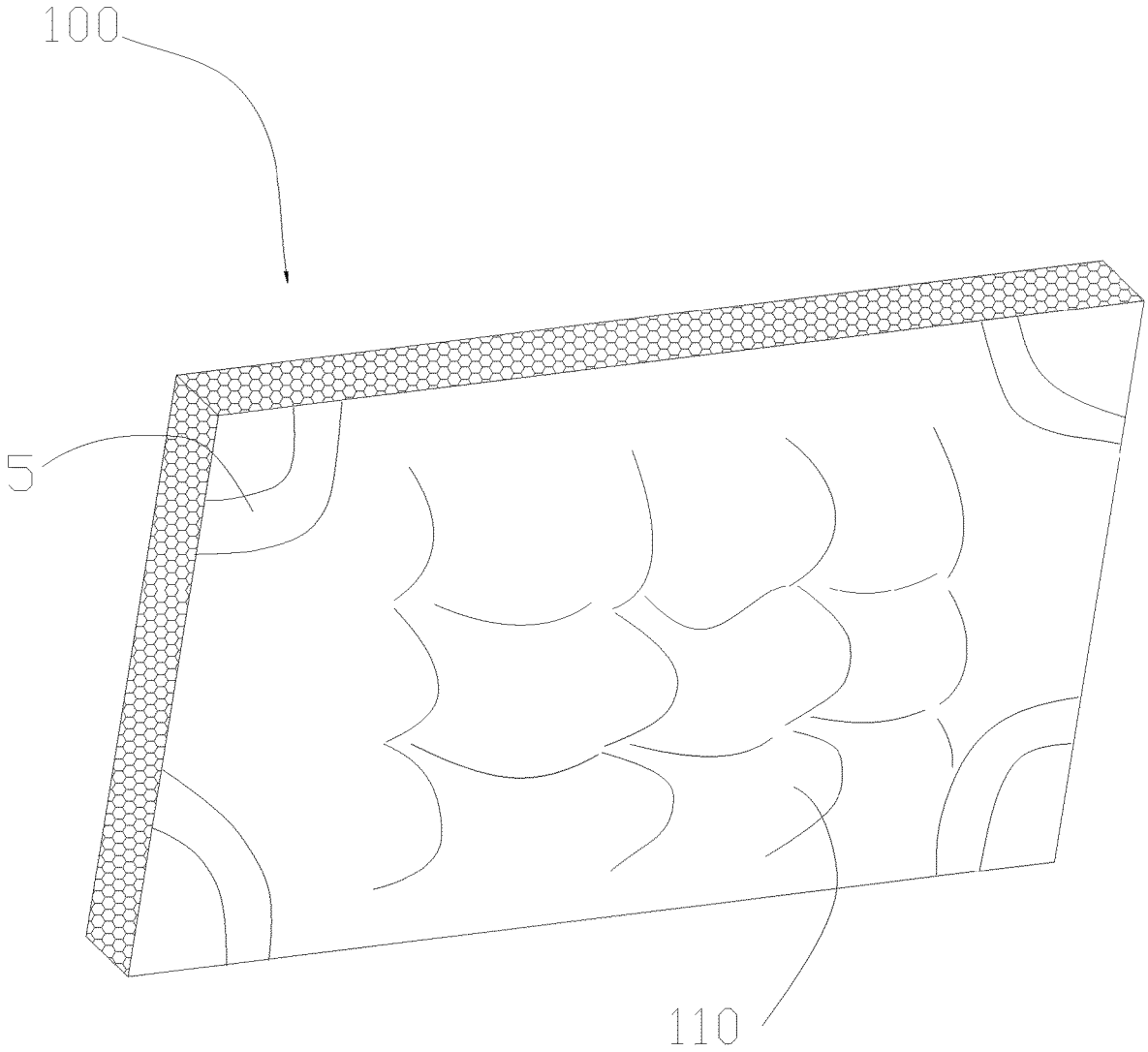
FIG. 7 shows a cross-sectional view of another embodiment of the present disclosure.

For one embodiment, referring to FIG. 7, the wrapping body 1 includes tightening straps 5 at the corners. Through the above structure, specifically, four tightening straps 5 are included, and the tightening straps are elastic. Users fit these elastic tightening straps 5 over the corners of the wrapping body 1 onto a mattress pad or wooden board beneath, which helps prevent the mattress from sliding or falling off during use.

For this embodiment, quilting lines 7 are also included. A number of quilting lines 7 dividing mattress 100 into several mattress units 110. Through the above structure, several quilting lines 7 prevent internal filling of the mattress 100 from moving or clumping together, maintaining an even distribution of filling. This ensures that the mattress 100 maintains better loft and warmth during use.

For this embodiment, the wrapping body 1 includes an upper layer 11, a side edge 12, and a lower layer 13. An upper edge of the side edge 12 is fixedly connected to a border of the upper layer 11, and a lower edge of the side edge 12 is fixedly connected to the border of the lower layer 13. The upper layer 11, the side edge 12, and the lower layer 13 together enclose the wrapping body 1.

Preferably, the upper layer 11 and the lower layer 13 are made of fabric materials, and the side edge 12 are arranged with a number of ventilation holes 121. Through the above structure, the fabric materials allows for improved air permeability of the mattress, reducing moisture on the mattress surface and providing a more comfortable sleep environment. The fabric materials on the mattress surface provides a skin-friendly feel, enhancing sleep comfort. Additionally, the ventilation holes 121 on the sides facilitate air circulation through the mattress, reducing moisture in the bedding and providing a more comfortable and healthy sleep environment.

For this embodiment, a first support bar 111 is arranged at the connection between the side 12 and the upper layer 11, and a second support bar 112 is arranged at the connection between the side 12 and the lower layer 13. Through the above structure, the first support bar 111 and the second support bar 112 provide a three-dimensional appearance and aesthetic appeal to the mattress, enhancing the mattress attractiveness to users.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A mattress, comprising:

a wrapping body, wherein a top of the wrapping body comprises a plurality of cavities independently set with each other;

a first filling material, wherein the first filling material is arranged in each cavity;

a second filling material, wherein the second filling material is arranged in each cavity, the first filling material and the second filling material are different materials; and a third filling material, wherein the third filling material is arranged in each cavity, the first filling material forms a first filling layer, the second filling material forms a second filling layer, and the third filling material forms a third filling layer, each cavity is successively filled with the first filling layer, the second filling layer, and the third filling layer from top to bottom, and the first filling material and the third filling material are made of the same material; and wherein the first filling material comprises chemical fibers, and the second filling material comprises memory foam or sponge;

wherein the wrapping body further comprises a side portion, the side portion is arranged at the periphery of the wrapping body and serves as an outward side wall of ones of the cavities arranged at the periphery of the top of the wrapping body to restrict the cavities on the top of the wrapping body, and a plurality of ventilation holes are disposed on the side portion.

2. The mattress of claim 1, wherein the first filling material is a flexible material filler, and a flexibility of the first filling material is greater than a flexibility of the second filling material.

3. The mattress of claim 1, wherein the second filling material is an elastic material filler, and an elasticity of the second filling material is greater than an elasticity of the first filling material.

4. The mattress of claim 1, wherein the second filling material further comprises gel particles.

5. The mattress of claim 1, wherein the mattress comprises a bed surround, the bed surround is fixedly connected to a lower surface around the wrapping body, and a bottom of the bed surround is arranged with a tightening edge.

6. The mattress of claim 5, wherein the bed surround is an elastic bed surround, and the tightening edge is an elastic drawstring.

7. The mattress of claim 1, wherein the mattress further comprises tightening straps, and the tightening straps are arranged at corners of the wrapping body.

8. The mattress of claim 7, wherein a number of the tightening straps are four, and the tightening straps are elastic tightening straps.

9. The mattress of claim 1, wherein the mattress further comprises a plurality of quilting lines, the quilting lines divide the mattress into a plurality of mattress units corresponding to the plurality of cavities, and each mattress unit comprises one corresponding cavity of the plurality of cavities.

10. The mattress of claim 1, wherein the wrapping body further comprises an upper layer and a lower layer, an upper edge of the side portion is fixedly connected to a border of the upper layer, and a lower edge of the side portion is fixedly connected to a border of the lower layer, and the upper layer, the side portion, and the lower layer together form the wrapping body.

11. The mattress of claim 10, wherein the upper layer and the lower layer are made of fabric.

12. The mattress of claim 11, wherein a first support bar is arranged at a connection part between the side portion and the upper layer, and a second support bar is arranged at a connection part between the side portion and the lower layer.

13. A mattress, comprising:

a wrapping body, wherein a top of the wrapping body comprises a plurality of cavities independently set with each other, and each of the cavities is filled with a first filling material and a second filling material different from the first filling material, wherein the first filling material comprises chemical fibers, and the second filling material comprises memory foam or sponge;

a bed surround, wherein the bed surround is fixedly connected to a lower surface around the wrapping body, and a bottom of the bed surround is provided with a tightening edge, the bed surround is an elastic bed surround, and the tightening edge is an elastic drawstring; and four tightening straps arranged at corners of the wrapping body, wherein the tightening straps are elastic tightening straps;

wherein the wrapping body further comprises a side portion, the side portion is arranged at the periphery of the wrapping body and serves as an outward side wall of ones of the cavities arranged at the periphery of the top of the wrapping body to restrict the cavities on the top of the wrapping body, and a plurality of ventilation holes are disposed on the side portion.

* * * * *